US010535916B2

(12) United States Patent
Lim et al.

(10) Patent No.: US 10,535,916 B2
(45) Date of Patent: Jan. 14, 2020

(54) WATCH-TYPE MOBILE TERMINAL

(71) Applicant: LG ELECTRONICS INC., Seoul (KR)

(72) Inventors: Yohan Lim, Seoul (KR); Jaehyun Choi, Seoul (KR); Byungwoon Jung, Seoul (KR); Chisang You, Seoul (KR); Hyengcheul Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/763,005

(22) PCT Filed: Dec. 8, 2015

(86) PCT No.: PCT/KR2015/013361

§ 371 (c)(1),
(2) Date: Mar. 23, 2018

(87) PCT Pub. No.: WO2017/051990

PCT Pub. Date: Mar. 30, 2017

(65) Prior Publication Data

US 2018/0294553 A1 Oct. 11, 2018

(30) Foreign Application Priority Data

Sep. 25, 2015 (KR) ..... 10-2015-0136620

(51) Int. Cl.
*H01Q 1/12* (2006.01)
*H01Q 1/27* (2006.01)
(Continued)

(52) U.S. Cl.
CPC ..... *H01Q 1/273* (2013.01); *G04G 17/04* (2013.01); *G04G 21/04* (2013.01); *H01Q 1/48* (2013.01);
(Continued)

(58) Field of Classification Search
CPC ..... H01Q 1/273; H01Q 5/35; H01Q 5/40; H01Q 5/371; H01Q 1/48; H01Q 9/42
(Continued)

(56) References Cited

U.S. PATENT DOCUMENTS 5,886,669 A * 3/1999 Kita ..... H01Q 1/273 343/700 MS
6,158,884 A * 12/2000 Lebby ..... G04B 47/00 224/165
(Continued)

FOREIGN PATENT DOCUMENTS

KR 1020140064694 5/2014
KR 1020150045746 4/2015
KR 1020150065506 6/2015

OTHER PUBLICATIONS

PCT International Application No. PCT/KR2015/013361, Written Opinion of the International Searching Authority dated Jun. 24, 2016, 23 pages.

*Primary Examiner* — Huedung X Mancuso
(74) *Attorney, Agent, or Firm* — Lee, Hong, Degerman, Kang & Waimey

(57) ABSTRACT

The present invention relates to a watch-type mobile terminal, comprising: a main body; a first band and a second band which are connected one side and the other side of the main body; a main board located inside the main body; a first antenna module mounted on the first band and connected to the main board to transmit and receive wireless signals; a second antenna module mounted on the second band and connected to the main board to transmit and receive wireless signals; and a control unit for maintaining the connection state between the second antenna and the main board when wireless communication is performed through the first antenna module, thereby using the second antenna module as the ground of the first antenna module. The watch-type
(Continued)

mobile terminal can enhance the efficiency of the antennas by minimizing interferences among a plurality of antennas.

15 Claims, 10 Drawing Sheets

(51) Int. Cl.

| | |
|---|---|
| ***G04G 17/04*** | (2006.01) |
| ***G04G 21/04*** | (2013.01) |
| ***H01Q 1/48*** | (2006.01) |
| ***H01Q 7/00*** | (2006.01) |
| ***H01Q 9/42*** | (2006.01) |
| ***H01Q 5/35*** | (2015.01) |
| ***H01Q 5/371*** | (2015.01) |
| ***H01Q 5/40*** | (2015.01) |
| *H01Q 1/38* | (2006.01) |
| *H01Q 1/22* | (2006.01) |
| *H01Q 1/24* | (2006.01) |
| *G04R 60/06* | (2013.01) |

(52) U.S. Cl.
CPC ..... *H01Q 5/35* (2015.01); *H01Q 5/371* (2015.01); *H01Q 5/40* (2015.01); *H01Q 7/00* (2013.01); *H01Q 9/42* (2013.01); *G04R 60/06* (2013.01); *H01Q 1/2291* (2013.01); *H01Q 1/241* (2013.01); *H01Q 1/38* (2013.01)

(58) Field of Classification Search
USPC ..... 343/718
See application file for complete search history.

(56) References Cited

U.S. PATENT DOCUMENTS

| | | | | |
|---|---|---|---|---|
| 2013/0107674 | A1* | 5/2013 | Gossweiler, III ..... | G04G 17/06 368/10 |
| 2013/0120106 | A1* | 5/2013 | Cauwels ..... | G06F 1/163 340/3.1 |
| 2013/0135972 | A1* | 5/2013 | Nakamura ..... | G04G 21/02 368/11 |
| 2014/0266624 | A1 | 9/2014 | Van Bosch et al. | |
| 2015/0223355 | A1 | 8/2015 | Fleck et al. | |

* cited by examiner (a)

(b)

(a)

(b)

WATCH-TYPE MOBILE TERMINAL

CROSS-REFERENCE TO RELATED APPLICATIONS

This application is the National Stage filing under 35 U.S.C. 371 of International Application No. PCT/KR2015/013361, filed on Dec. 8, 2015, which claims the benefit of earlier filing date and right of priority to Korean Application No. 10-2015-0136620, filed on Sep. 25, 2015, the contents of which are all hereby incorporated by reference herein in their entirety.

TECHNICAL FIELD

The present invention relates to a watch-type mobile terminal equipped with a plurality of antennas to perform various types of wireless communication.

BACKGROUND ART

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

As such functions become more diversified, the mobile terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

Moreover, as a portable terminal is disseminated as a terminal carried by each person, various designs are applied to the portable terminal to express a unique character of the person.

A traditional portable terminal is formed by a size capable of being held by a hand and is carried by a hand or is carried in a manner of being put into a pocket or a bag. While the portable terminal is carried, the portable terminal may be lost or damaged due to the dropping or the like. Moreover, it is not convenient to carry the portable terminal.

In order to resolve the problem, a wearable terminal of various types is appearing. For example, a watch-type portable terminal capable of being worn on a wrist, a portable terminal capable of being worn on a neck, a portable terminal capable of being worn on a waist, and the like are appearing. A size and a function of a wearable terminal may vary according to a wearing form. It may use various types of a watch-type mobile terminal according to the necessity of a user.

In case of a watch-type mobile terminal, unlike a terminal of a bar shape or a terminal of a folder shape, since a size of the watch-type mobile terminal is getting smaller, it is difficult to secure a space for mounting parts. Moreover, since such a device for transmitting and receiving a signal as an antenna is influenced by a nearby electronic device, it is difficult to deploy the device.

DISCLOSURE OF THE INVENTION

Technical Task

An object of the present invention is to provide a watch-type mobile terminal using a plurality of antennas capable of minimizing mutual interference and enhancing signal transmission/reception efficiency.

Technical Solution

To achieve these and other advantages and in accordance with the purpose of the present invention, as embodied and broadly described, according to one embodiment, a watch-type mobile terminal includes a main body, a first band and a second band respectively connected with one side and another side of the main body, a mainboard positioned at the inside of the main body, a first antenna module mounted on the first band and the first antenna module configured to transmit and receive a radio signal in a manner of being connected with the mainboard, a second antenna module mounted on the second band and the second antenna module configured to transmit and receive a radio signal in a manner of being connected with the mainboard, and a controller configured to use the second antenna module as a ground of the first antenna module by maintaining a connected state between the second antenna module and the mainboard when wireless communication is performed through the first antenna module.

The first antenna module includes a first radiator connected with the mainboard and the first radiator extended in a manner of being bent several times and the second antenna module can include a second radiator connected with the mainboard and the second radiator of a form of a spiral wound several times.

The first radiator may correspond to a main antenna configured to transmit and receive an LTE (long term evolution) signal and the second radiator may correspond to an NFC (near field communication) antenna.

The second radiator can be used as a wireless charging coil configured to charge a battery according to a change of a magnetic field.

In this case, the first radiator can include a first pattern connected with the mainboard and the first pattern extended in a first direction in a manner of being bent several times and a second pattern bent several times at another end of the first pattern and the second pattern extended in a second direction corresponding to an opposite direction of the first direction.

The first antenna module can further include a third antenna radiator connected with the mainboard and the third antenna radiator deployed in a manner of being separated from the first antenna radiator.

The third antenna may correspond to a Bluetooth/WiFi antenna.

The first antenna module further includes an insulating layer on which the first radiator and the third radiator are formed and the insulating layer including a first connection part and a second connection part extended in one end of the insulating layer, and a connector contacted with an access terminal of the mainboard in a manner of being coupled with end parts of the first connection part and the second connection part, an end of the first radiator is positioned at the center part of the first connection part, and an end of the second radiator can be positioned at the center part of the second connection part.

The second radiator can further include a first access line positioned at one side of one face of the insulating layer by passing through another face of the insulating layer by penetrating the insulating layer from an inside of the spiral and penetrating the insulating layer again, and a second access line positioned at one side of one face of the insulating layer in a manner of being extended from an outside of the spiral.

The second antenna module can further include an insulating layer at which the second radiator is positioned and a fourth radiator formed on another face of the insulating layer and the fourth radiator overlapped with the second radiator.

The second antenna module can further include a fifth radiator formed on another face of the insulating layer, the fifth radiator not overlapped with the second radiator, the fifth radiator deployed in a manner of being separated from the third radiator.

The fourth radiator may correspond to a MIMO antenna and the fifth radiator may correspond to a GPS (global positioning system) antenna configured to receive a signal transmitted from a satellite.

The fourth radiator and the fifth radiator can further include a third access line and a fourth access line positioned at one side of one face of the insulating layer by penetrating the insulating layer.

The mainboard can further include an access terminal positioned at the front side of the mainboard and wherein the first antenna module and the second antenna module can include a connector connected with the access terminal.

Thickness of a part adjacent to the main body is thicker than thickness of a different part in the first band and the second band and the connector can be positioned at an upper side in a thickness direction of the first band and the second band.

The access terminal can include a supporting unit protruded in a front side direction of the mainboard and an elastic clip protruded from the supporting unit.

The main body includes a metal material and the first antenna module and the second antenna module can be electrically connected with the main body through the mainboard to make the main body operate as a ground.

The watch-type mobile terminal can further include connection holes formed on one side and another side of the main body. In this case, the first antenna module and the second antenna module can further include a connector connected with the mainboard and a sealing unit configured to fill a space between the connection holes and the connector in a manner of being positioned near the connector.

Advantageous Effects

According to at least one embodiment of the present invention, it is able to enhance efficiency of antennas by minimizing an impact among a plurality of antennas.

And, it is able to minimize deterioration of antenna efficiency influenced by a human body of a user by separately deploying a contact point between a main board and a radiator from a wrist of the user.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BEST MODE

Mode for Invention

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

Figure 1:
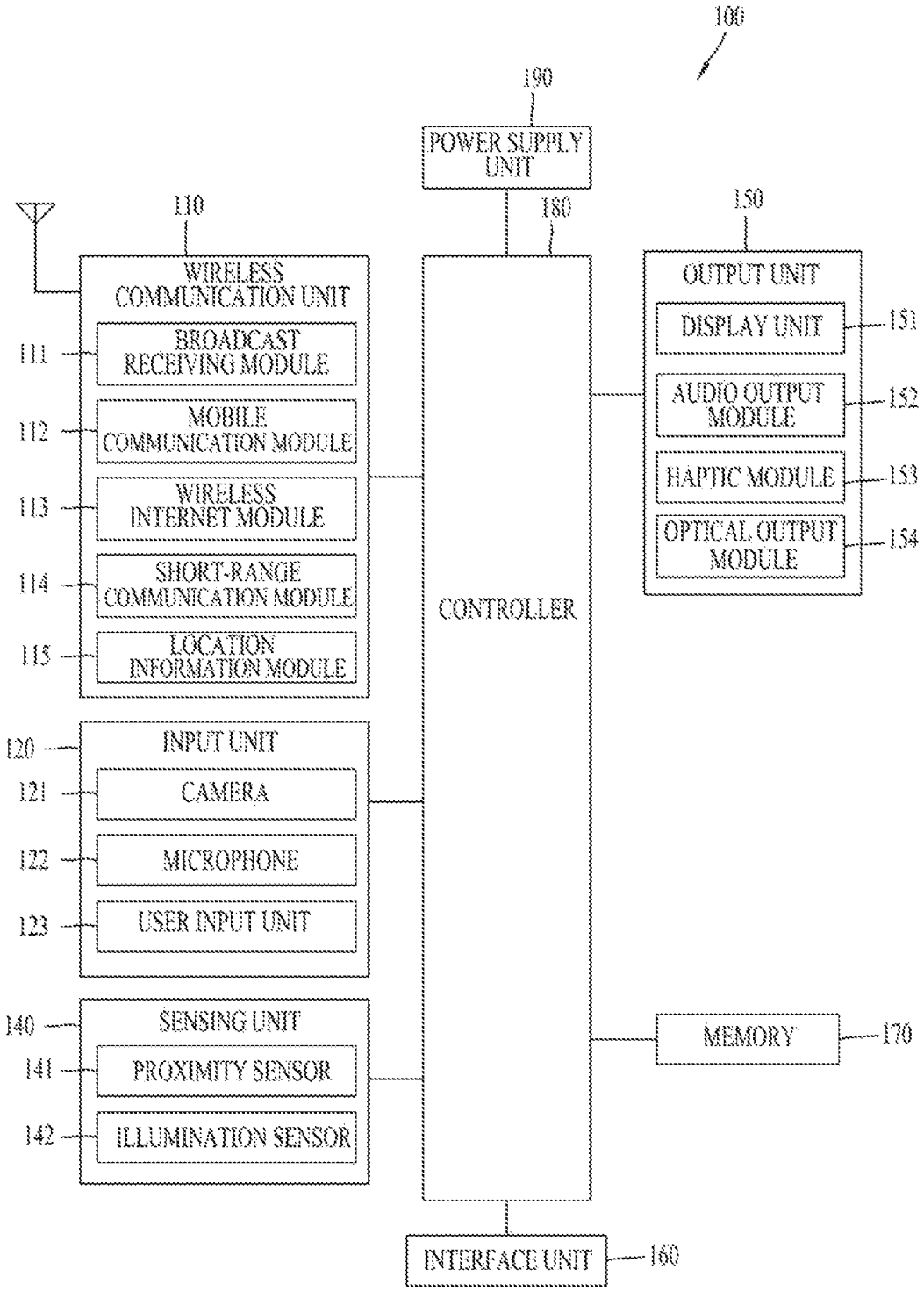
FIG. 1 is a block diagram of a watch type mobile terminal in accordance with the present disclosure.

FIG. 1 is a block diagram of a mobile terminal in accordance with the present disclosure.

The watch type mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components in The FIG. 1A is not a requirement, and that greater or fewer components may alternatively be implemented.

More specifically, the wireless communication unit 110 typically includes one or more modules which permit communications such as wireless communications between the watch type mobile terminal 100 and a wireless communication system, communications between the watch type mobile terminal 100 and another mobile terminal, communications between the watch type mobile terminal 100 and an external server. Further, the wireless communication unit 110 typically includes one or more modules which connect the watch type mobile terminal 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, the sensing unit 140 may alternatively or additionally include other types of sensors or devices, such as a proximity sensor 141 and an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The watch type mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154. The display unit 151 may have an inter-layered structure or an integrated structure with a touch sensor in order to facilitate a touch screen. The touch screen may provide an output interface between the watch type mobile terminal 100 and a user, as well as function as the user input unit 123 which provides an input interface between the watch type mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the watch type mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the watch type mobile terminal 100 at time of manufacturing or shipping, which is typically the case for basic functions of the watch type mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 may provide or process information or functions appropriate for a user by processing signals, data, information and the like, which are input or output, or activating application programs stored in the memory 170.

To drive the application programs stored in the memory 170, the controller 180 may be implemented to control a predetermined number of the components mentioned above in reference with FIG. 1A. Moreover, the controller 180 may be implemented to combinedly operate two or more of the components provided in the watch type mobile terminal 100 to drive the application programs.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

Some or more of the components may be operated cooperatively to embody an operation, control or a control method of the mobile terminal in accordance with embodiments of the present disclosure. Also, the operation, control or control method of the mobile terminal may be realized on the mobile terminal by driving of one or more application problems stored in the memory 170.

Moreover, the controller 180 authenticates a sensed external terminal to communicate with the watch-type mobile terminal 100 and controls the external terminal to transmit at least a part of data processed in the external terminal to the wearable device 100 via the short-range communication module 114. On the contrary, a signal or a command inputted via the wearable device 100 can be transmitted to the external terminal via the short-range communication module 114 to control the external terminal.

For example, when a phone call is received at the external terminal, it may be able to perform telephone call via the watch-type mobile terminal 100. Or, when a message is received at the external terminal, it may be able to check the message through the watch-type mobile terminal 100.

Since short-range wireless communication transmits and receives a signal with an external terminal located within a short distance, the short-range wireless communication uses a low frequency delivered in a manner of being stick to the ground rather than a frequency spread into the air.

The mobile communication module 112 can transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like). A radio signal is transmitted and received to/from at least one selected from the group consisting of a base station, an external terminal, and a server in a mobile communication network constructed according to each of the wireless communication standards.

Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the mobile terminal 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

The location information module 115 is generally configured to detect, calculate, derive or otherwise identify a position of the mobile terminal. As an example, the location information module 115 includes a Global Position System (GPS) module, a Wi-Fi module, or both.

If desired, the location information module 115 may alternatively or additionally function with any of the other modules of the wireless communication unit 110 to obtain data related to the position of the mobile terminal. As one example, when the mobile terminal uses a GPS module, a position of the mobile terminal may be acquired using a signal sent from a GPS satellite.

As another example, when the mobile terminal uses the Wi-Fi module, a position of the mobile terminal can be acquired based on information related to a wireless access point (AP) which transmits or receives a wireless signal to or from the Wi-Fi module.

Figure 2:
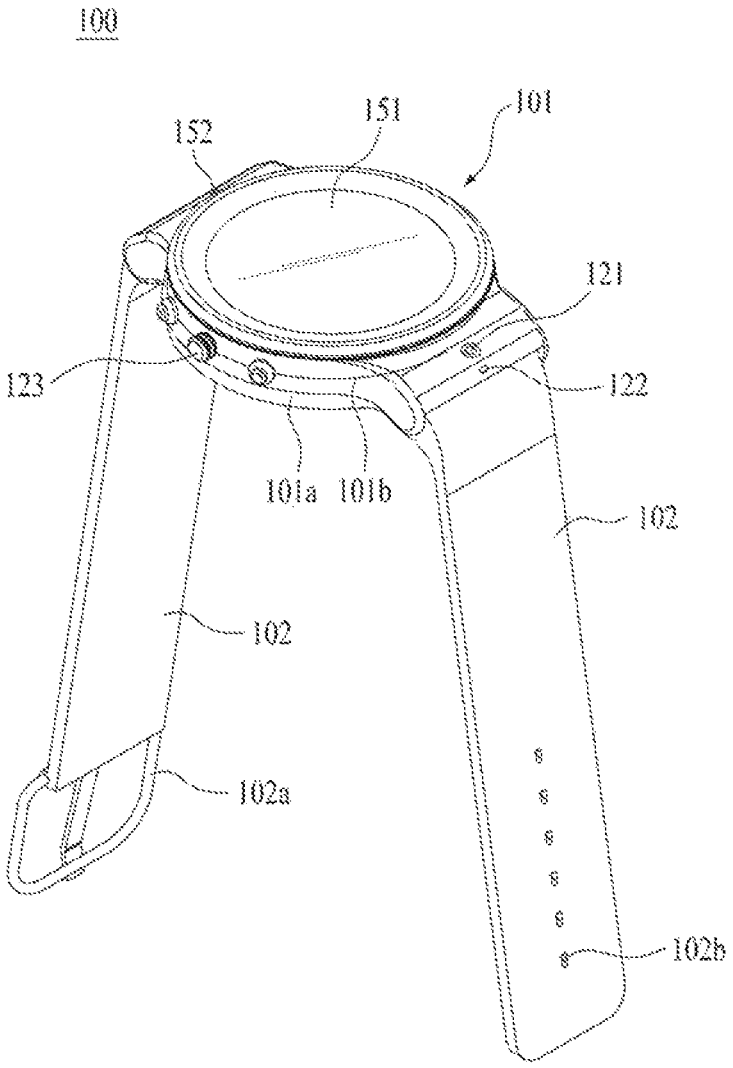
FIG. 2 is a perspective diagram illustrating one embodiment of a watch-type mobile terminal according to the present invention.

FIG. 2 is a perspective view illustrating one example of a watch-type mobile terminal 100 in accordance with another exemplary embodiment. As illustrated in FIG. 2, the watch-type mobile terminal 100 includes a main body 101 with a display unit 151 and a band 102 connected to the main body 101 to be wearable on a wrist.

The main body 101 may include a case having a certain appearance. As illustrated, the case may include a first case 101*a* and a second case 101*b* cooperatively defining an inner space for accommodating various electronic components. Other configurations are possible. For instance, a single case may alternatively be implemented, with such a case being configured to define the inner space, thereby implementing a mobile terminal 100 with a uni-body.

The watch-type mobile terminal 100 can perform wireless communication, and an antenna for the wireless communication can be installed in the main body 101. The antenna may extend its function using the case. For example, a case including a conductive material may be electrically connected to the antenna to extend a ground area or a radiation area.

The display unit 151 is shown located at the front side of the main body 101 so that displayed information is viewable to a user. In some embodiments, the display unit 151 includes a touch sensor so that the display unit can function as a touch screen. As illustrated, window 151*a* is positioned on the first case 101*a* to form a front surface of the terminal body together with the first case 101*a*.

The illustrated embodiment includes audio output module 152, a camera 121, a microphone 122, and a user input unit 123 positioned on the main body 101. When the display unit 151 is implemented as a touch screen, additional function keys may be minimized or eliminated. For example, when the touch screen is implemented, the user input unit 123 may be omitted.

The band 102 is commonly worn on the user's wrist and may be made of a flexible material for facilitating wearing of the device. As one example, the band 102 may be made of fur, rubber, silicon, synthetic resin, or the like. The band 102 may also be configured to be detachable from the main body 101. Accordingly, the band 102 may be replaceable with various types of bands according to a user's preference.

The band 102 may include fastener 302*a*. The fastener 102*a* may be implemented into a buckle type, a snap-fit hook structure, a Velcro® type, or the like, and include a flexible section or material. The drawing illustrates an example that the fastener 102*a* is implemented using a buckle. When the fastener 102*a* of a buckle type is implemented, it may be able to form a hole 102*b* in a band 102 of an opposite side to insert a locking pin of the buckle to the hole.

Figure 3:
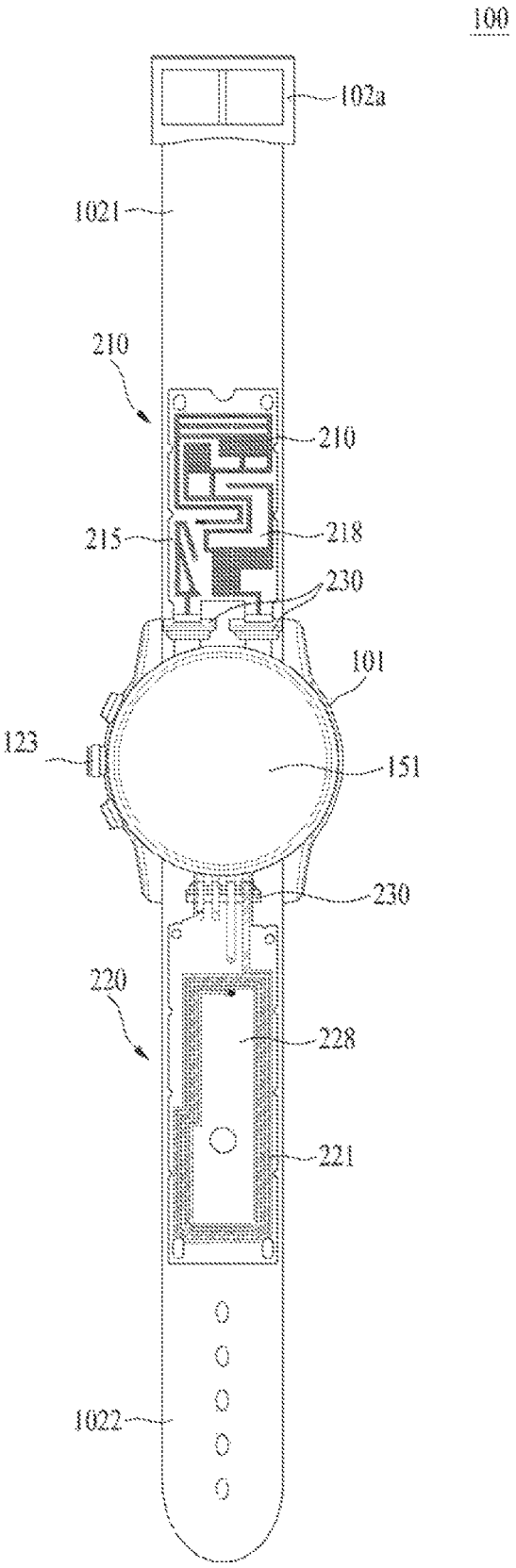
FIG. 3 is a diagram illustrating an antenna mounted on a band of a watch-type mobile terminal according to one embodiment of the present invention.
Figure 4:
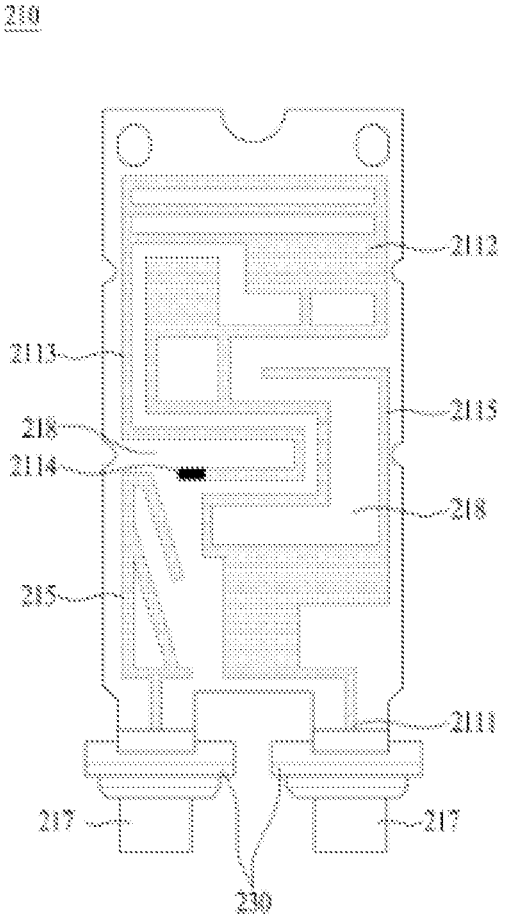
FIG. 4 is a diagram illustrating a first antenna module of a watch-type mobile terminal according to one embodiment of the present invention.

FIG. 3 is a diagram illustrating antenna modules 210, 220 mounted on a band 102 of a watch-type mobile terminal 100 according to one embodiment of the present invention. FIG. 4 is a diagram illustrating a first antenna module 210 of a watch-type mobile terminal 100 according to one embodiment of the present invention.

The watch-type mobile terminal 100 can include a first antenna module 210 positioned at a first band 1021 coupled with one side of the main body and a second antenna module 220 positioned at a second band 1022. The first antenna module 210 can include a first radiator 211 and a third radiator 215 and the second antenna module 220 can include a second radiator 221, a fourth radiator 222, and a fifth radiator 223.

The first antenna module 210 includes the first radiator 211 used for mobile communication. The first radiator 211 can be implemented by forming a pattern on an insulating layer 218. The first radiator 211 can be used as a main antenna for transmitting and receiving an LTE (long term evolution) signal. The first radiator 211 includes a first pattern 2112 and a second pattern 2113.

One end of the first pattern 2112 is connected to a main board 185 and is extended in a first direction in a manner of being bent several times from one end. The second pattern 2113 is extended in a second direction corresponding to an opposite direction of the first direction in a manner of being bent several times from another end.

Referring to FIG. 4, the first direction corresponds to an up direction heading away from the main body in the drawing and the second direction corresponds to a down direction heading to the main body in the drawing. When a pattern is extended in the first direction or the second direction, as shown in FIG. 4, it may indicate a position relation between one side and another side of the first pattern 2112 and the second pattern 2113 and includes a part extended in a manner of being bent in a width direction of the band 102.

Instead of a concept that the first pattern 2112 is precisely distinguished from the second pattern 2113, the patterns are designed as follows. In particular, the first radiator 211 is extended in the first direction and returns to the second direction. And, an end part 2114 of the first radiator 211 is positioned at a point close to the main body 101 as close as possible. When wireless communication is performed, although a signal is transmitted from the entire radiator of an antenna, signal strength is strongest at the end part.

When a user wears the band 102 on a wrist, since a signal radiated from a radiator is influenced by a human body, an efficiency deterioration problem may occur. In order to minimize the problem, it is preferable to deploy end parts 2111, 2114 of the first radiator 211 to a position separated from the wrist as far as possible.

Figure 5:
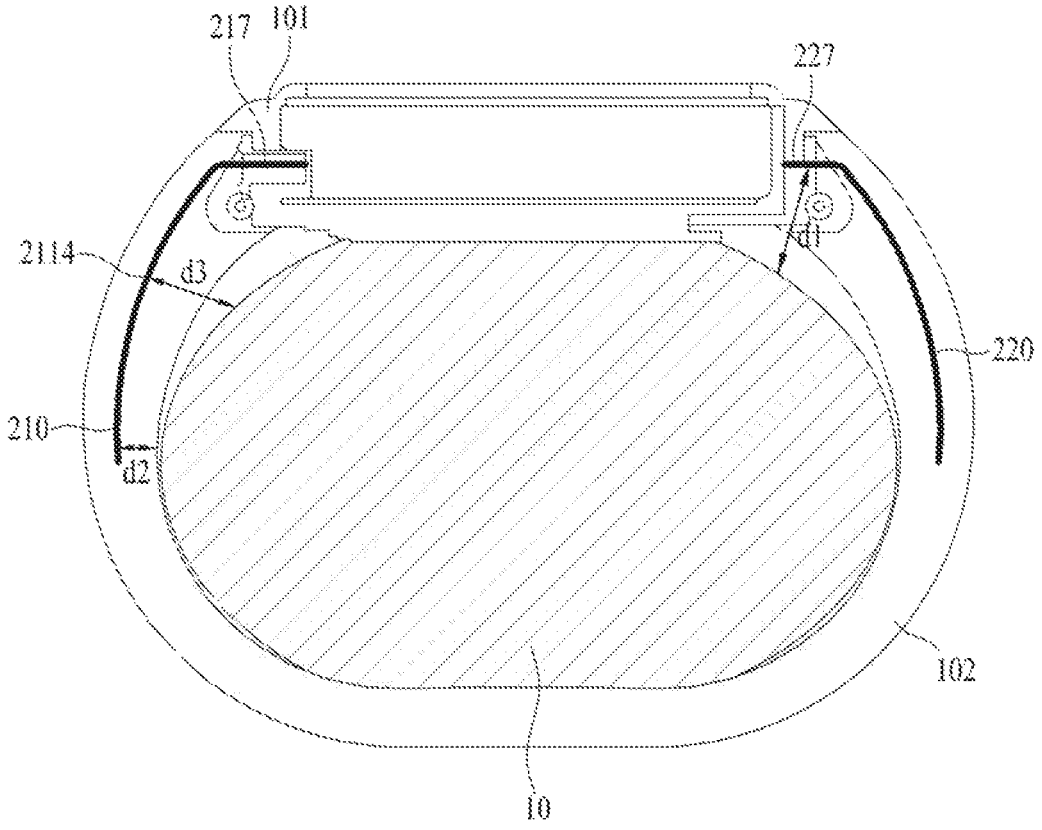
FIG. 5 is a cross-sectional diagram for a watch-type mobile terminal according to the present invention.

FIG. 5 is a cross-sectional diagram for a watch-type mobile terminal 100 according to the present invention. FIG. 5 illustrates a state that a user is wearing the watch-type mobile terminal 100. FIG. 5 illustrates a distance between antenna modules 210/220 positioned at the band 102 and a wrist 20 when the user wears the watch-type mobile terminal on the wrist 10. Since the main body 101 is not bendable, as shown in FIG. 5, both ends (d1) of the main body 101 are separated from the wrist 10 and become points farthest from the wrist 10.

Although a part of the band 102 coupled with the main body 102 is positioned in a manner of being separated from the wrist 10, a distance (d2) between the wrist 10 and a first antenna module 210 is getting closer as the band 102 is extended in a length direction. When the first radiator 211 is extended in a first direction, the first radiator 211 can be extended in a second direction in a manner of being bent to make another end of the first radiator 211 to be positioned at a position close to the main body 101.

The first radiator 211 includes a part where thickness of a pattern is partly changed. A length of the first radiator 211 may vary depending on a frequency of a signal to be transmitted and received by the first radiator 211. In general, an LTE signal has a difference according to a country and a telecommunication company. A single telecommunication company performs mobile communication using a plurality of frequency bands. Since not only LTE but also $3^{rd}$ generation mobile communication scheme such as CDMA or WCDMA is still used, it is necessary to have an antenna satisfying a frequency band of CDMA or WCDMA.

In particular, in order to transmit and receive a signal of various frequency bands, the first radiator 211 can further include an additionally extended third pattern 2115 as well as the first pattern 2112 and the second pattern 2113. Since the third pattern 2115 is different from the first pattern 2112 and the second pattern 2113 in a length and a shape, the third pattern 2115 can transmit and receive a mobile communication signal of a different frequency band.

The first radiator 211 can be electrically connected with the cases 101*a*/101*b* of the main body 101 or a metal frame of the main body 101 made of a metal material. The main body 101 made of a metal material may play a role of a ground. The ground should not be overlapped with the first radiator 211. When an antenna operates, a signal is emitted not only to the first radiator 211 bit also to the case of the main body 101. In particular, since the ground is able to play a role of a radiator, if there is a wider ground, it may be able to stably transmit and receive a signal.

Referring to FIG. 4, a third radiator 215 is positioned in a manner of being separated from the first radiator 211. The third radiator 215 corresponds to a Bluetooth/WiFi antenna configured to transmit and receive a short-range signal of a frequency band (2400~2483.5 MHz). Since the third radiator 215 has a difference in a frequency band compared to other wireless communication bands, the third radiator has a relatively less influence on the first radiator 211.

Figure 6:
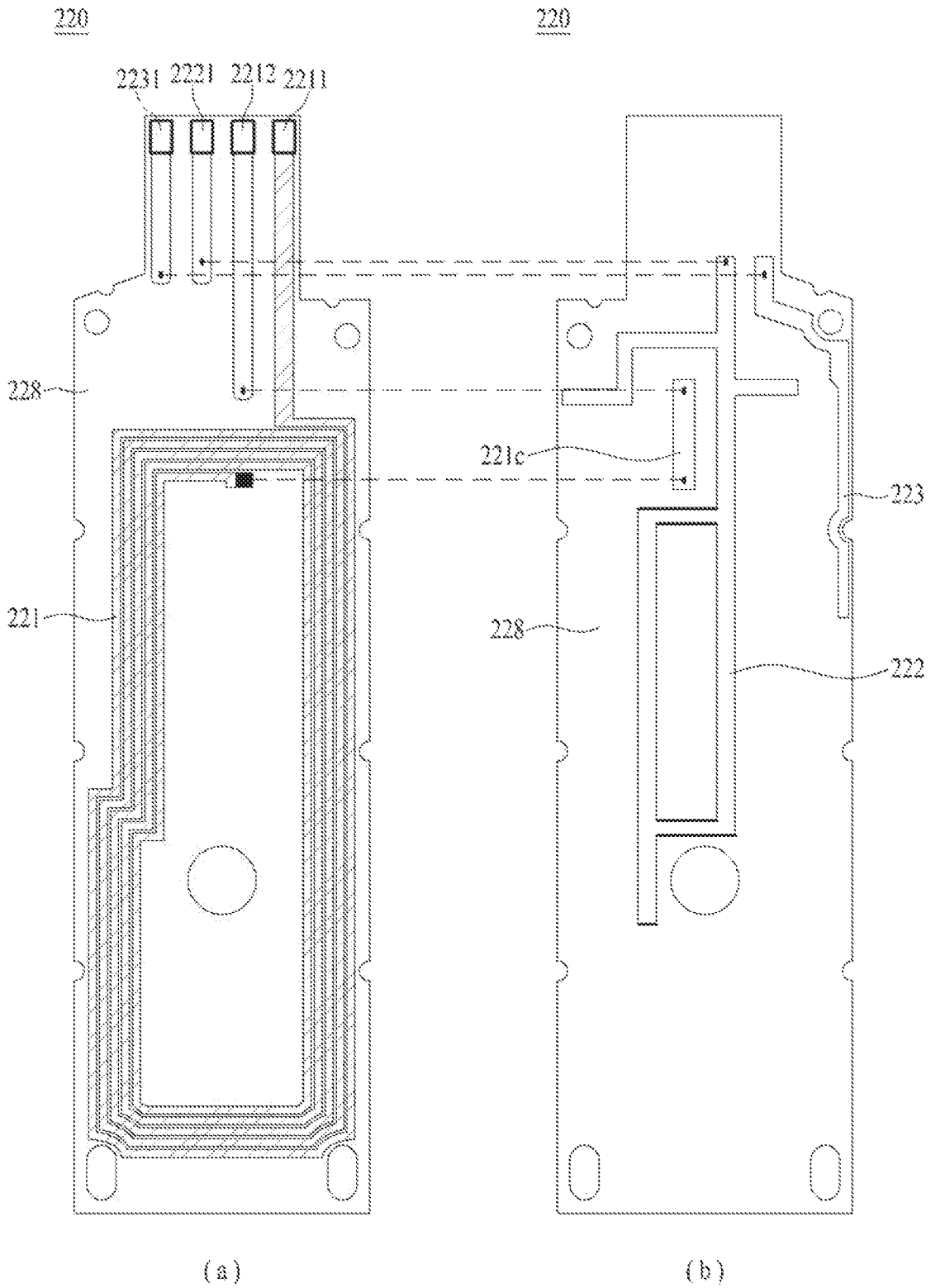
FIG. 6 is a diagram illustrating a second antenna module of a watch-type mobile terminal according to one embodiment of the present invention.

FIG. 6 is a diagram illustrating a second antenna module 220 of a watch-type mobile terminal 100 according to one embodiment of the present invention. The second antenna module 220 can be formed on both sides of an insulating layer 228. An antenna pattern is formed using both sides of the insulating layer to utilize an insufficient space.

The second radiator 221 formed on one side of the insulating layer 228 includes a pattern of a coil shape. It is not mandatory that a coil shape has a circle form. As shown in FIG. 6, the coil shape may have a shape of a polygon. One side of a coil pattern is positioned at the inside of a coil and another side of the coil patter is positioned at the outside of the coil.

The second radiator 221 can be used as an NFC antenna used for a noncontact communication technology using 13.56 MHz frequency band corresponding to one of RFID technologies. Since the noncontact communication technology has a short communication distance, security is excellent. Moreover, since the noncontact communication technology uses a very low frequency compared to a different frequency band, there is almost no signal and interference received from a different frequency band.

A length of the entire antenna is long to transmit and receive a signal of a low frequency band and one side 2211 and another side 2212 of a coil are connected to the main board 185. A deployment structure of a plurality of access terminals 187 can be simplified by deploying a plurality of the access terminals 187 of the main board 185 in a raw. In order to be coupled with a plurality of the access terminals 197 deployed in a raw, access lines 2211/2212/2221/2231 corresponding to end points of each of radiators can be positioned at the same face of the insulating layer 228.

A first access line 2211, which is extended from an end part positioned at the outside of a spiral coil of the second radiator 221, is positioned at one side of the insulating layer 228. As shown in FIG. 6 (*b*), an end part positioned at the inside of the spiral coil of the second radiator 221 includes a second access line 2212, which is extended in a direction of another side of the insulating layer 228 as much as a certain amount 221*c* by penetrating the insulating layer 228 and is extended in a direction of one side of the insulating layer 228 by penetrating the insulating layer 228 again at the outside of the spiral coil. The first access line 2211 and the second access line 2212 are connected with the access terminal 187 of the main board 185 via a connector 227.

As mentioned in the foregoing description, it is necessary to widen an area of the ground to enhance performance of the first radiator 211. However, since a size of the watch-type mobile terminal 100 is small, it is difficult to secure a ground of a sufficient size. According to the present invention, when the first radiator 211 operates, if the first radiator 211 positioned at the first band 1021 and the second radiator 221 positioned at the second band 1022 are deployed to a different side, the second radiator 221 can be used as another ground.

Since the second radiator 221 has a shape of a coil and uses a signal of a low frequency band, an area of the second radiator 221 is wider than that of a different radiator. In particular, when the first radiator 211 operates, if a connection between the second radiator 221 and the main board 185 is maintained, the second radiator 221 also emits a signal as a ground while transmitting and receiving a signal of a frequency band of the first radiator 211.

The second radiator 221 can be used as a wireless charging coil. Wireless charging uses a low frequency band lower than an NFC signal, i.e., a low frequency band equal to or higher than 100 kHz and equal to or lower than 260 kHz. Since a difference between the low frequency band and a frequency band used by a mobile communication antenna or a GPS antenna is big, interference between radio signals is less.

If a wireless charging coil is additionally installed in the inside of the main body 101 or the band 102, similar to the second radiator 221, the wireless charging coil may play a role of a ground when a signal is transmitted using the first radiator 211.

Similar to the first antenna module 210, a wireless charging coil can be deployed in a manner of not to be overlapped with the second antenna module 220. When at least one of the first antenna module 210 and the second antenna module 220 performs transmit and receive a radio signal, not only the first radiator but also the wireless charging coil not overlapped with the second antenna module can be used as a ground. By doing so, it may be able to obtain an effect of expanding a ground area without increasing a size of the main body 101.

Figure 7:
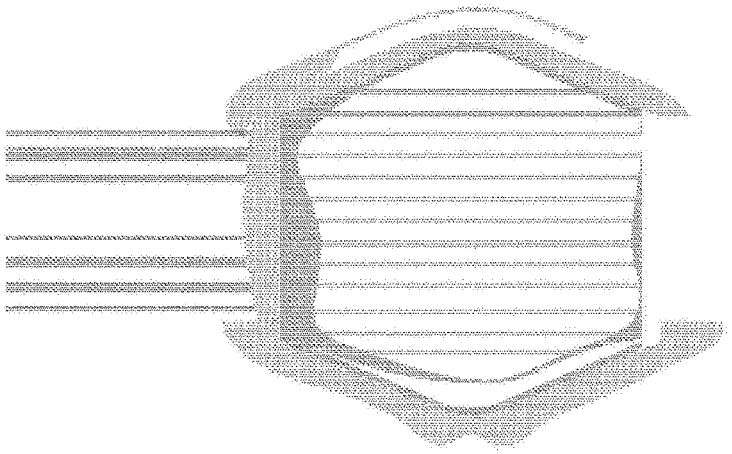
FIG. 7 is a diagram illustrating radiation performance when wireless communication is performed using a first radiator.
Figure 7:
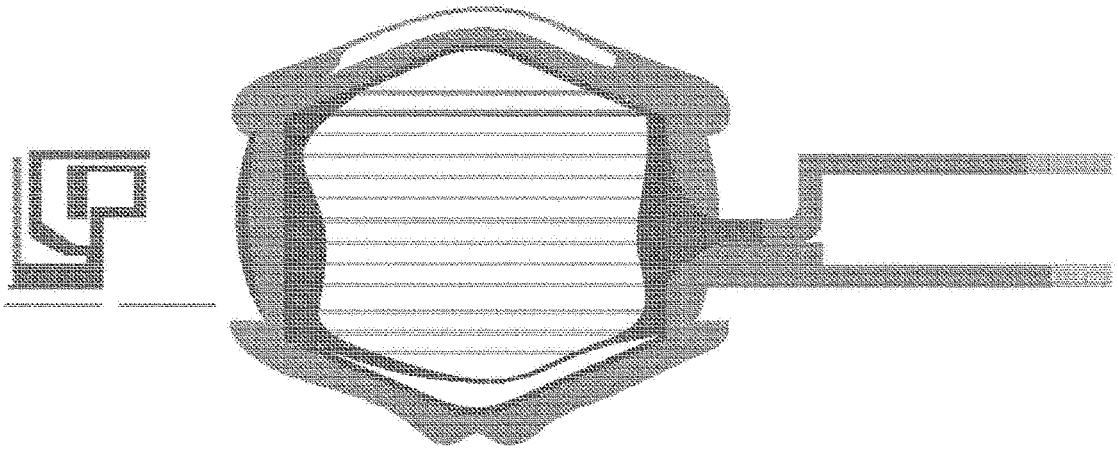

FIG. 7 is a diagram illustrating radiation performance when wireless communication is performed using a first radiator 211. According to the related art, when a plurality of antennas are used, if one of a plurality of the antennas is used, access between a different antenna and a main board 185 is terminated to minimize interference of the different antenna. On the contrary, the antenna modules 210/220 of the present invention enhance performance of a mobile communication antenna.

When the first radiator 211 operates, FIG. 7 (*a*) illustrates radiation performance in a state that a connection between the main board 185 and the second radiator 221 is disconnected. When first radiator 211 operates, FIG. 7 (*b*) illustrates radiation performance in a state that a connection between the main board 185 and the second radiator 221 is not disconnected. Referring to FIG. 7 (*a*), a signal is not transmitted and received at a part (right side) at which the second radiator 221 is positioned. On the contrary, referring to FIG. 7 (*b*), since the second radiator 221 is also able to transmit and receive a signal, it is able to enhance mobile communication performance using the first radiator 211.

A fourth radiator 222 is formed at another side of the insulating layer 228 and corresponds to a MIMO antenna that performs mobile communication. The MIMO antenna corresponds to an antenna system capable of performing MIMO (multiple input multiple output). In MIMO system, two or more antennas are installed in a base station and a mobile terminal, respectively. In particular, the fourth radiator is deployed in a manner of being separated from the first radiator 211 and transmits and receives a signal of a frequency band different from a frequency band of the first radiator 211 (the fourth radiator may have a frequency band partly overlapped with a frequency band of the first radiator).

The first radiator 211 functions as a main antenna and the fourth radiator 222 assists in performing a function of the first radiator 211. In particular, the fourth radiator may help the first radiator to transmit fast data. If it is difficult to perform mobile communication using the first radiator 211, it may use the fourth radiator 222.

Since the watch-type mobile terminal 100 does not have a sufficient space on which an antenna is to be mounted, the fourth radiator 222 can be formed in a manner of being overlapped with the second radiator 221. Since there is a big difference between a frequency band of a signal transmitted by the second radiator 221 and a frequency band of a signal transmitted by the fourth radiator, the fourth radiator receives a less influence. Moreover, if the second radiator 221 is equipped with a filter for eliminating a signal of a high frequency band and the fourth radiator 222 is equipped with a filter for eliminating a signal of a low frequency band, it may be able to more reduce an impact between the second radiator 221 and the fourth radiator 222.

It may be able to form a fifth radiator 223 on another side of the insulating layer 228 in a manner of being separated from the fourth radiator 222. The fifth radiator 223 can be used as a GPS (global positioning system) antenna configured to receive a signal transmitted from a satellite.

A GPS corresponds to a system for searching for a position in a 3D space using a satellite. Since a user moves while wearing the watch-type mobile terminal 100, it may be able to check a position of the user using the GPS. The GPS may use a signal of about 1580 MHz. Although a frequency band of the GPS is not overlapped with a frequency band of mobile communication, since the frequency bands are adjacent to each other, the fifth radiator 223 may considerably influence on the mobile communication.

Figure 8:
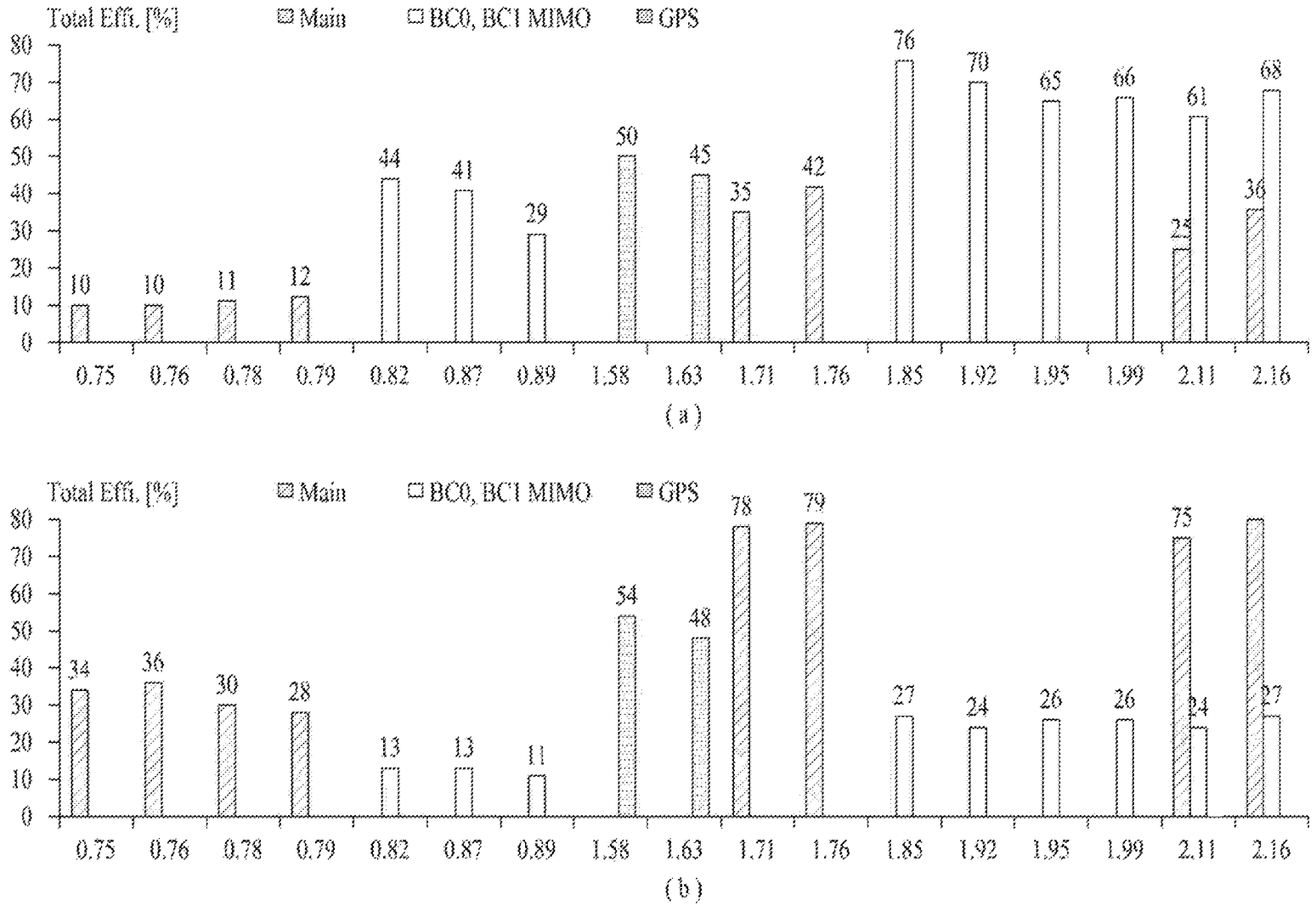
FIG. 8 is a graph for explaining antenna performance of a watch-type mobile terminal according to the present invention.

As a result, a GPS antenna is deployed to a part adjacent to the second band 1022 in a manner of being separated from the first radiator 211 which is used as a main antenna. FIG. 8 is a graph for explaining antenna performance of the watch-type mobile terminal 100 according to the present invention. FIG. 8 (*a*) is a graph illustrating signal strength according to a frequency band when the fifth radiator 223 configured to receive a GPS signal and the first radiator 211 corresponding to a main antenna are deployed to the first band 1021 together. FIG. 8 (*b*) is a graph illustrating signal strength according to a frequency band when the fifth radiator 223 is deployed to an opposite side (i.e., the second band 1022) of the first radiator 211.

Since an antenna for mobile communication is used for long distance wireless communication, a small difference makes a considerable difference in performance. Hence, in designing an antenna, efficiency of a mobile communication antenna is most important. Hence, it is necessary to enhance efficiency of the first radiator 211 corresponding to a main antenna. The fifth radiator 223 receives a GPS signal in frequency bands including 1.58 GHz and 1.63 GHz (including an error). The first radiator 211 transmits and receives a signal in a frequency band ranging from 0.75 GHz to 0.79 GHz, a frequency band ranging from 1.71 GHz to 1.76 GHz, and a frequency band ranging from 2.11 GHz to 2.16 GHz. The fourth antenna corresponding to an auxiliary antenna used for mobile communication transmits and receives a signal in a frequency band ranging from 0.82 GHz to 0.89 GHz and a frequency band ranging from 1.85 GHz to 2.16 GHz.

Since a signal of a frequency band of the fifth antenna is adjacent to a mobile communication frequency, the mobile communication frequency is influenced by the signal of the fifth antenna. In particular, FIG. 8 (*a*) shows transmission/reception efficiency of the first antenna corresponding to about 30% of transmission/reception efficiency of the first antenna shown in FIG. 8 (*b*).

Although the efficiency of the fourth antenna shown in FIG. 8 (*b*) is lower than the efficiency of the fourth antenna shown in FIG. 8 (*a*), since the efficiency of the first radiator 211 configured to transmit and receive a signal of a mainly used frequency band more influences on mobile communication phone call quality, the present invention proposes to deploy the first radiator 211 and the fifth radiator 223 to a different band 102.

Figure 9:
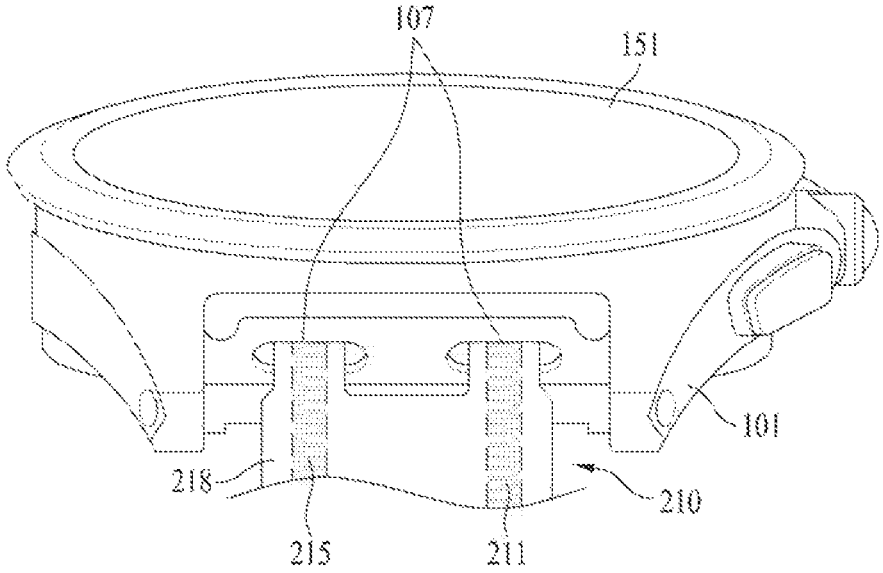
FIG. 9 is a diagram illustrating deployment of a radiator for accessing an antenna module and a main board of a watch-type mobile terminal according to the present invention.
Figure 9:
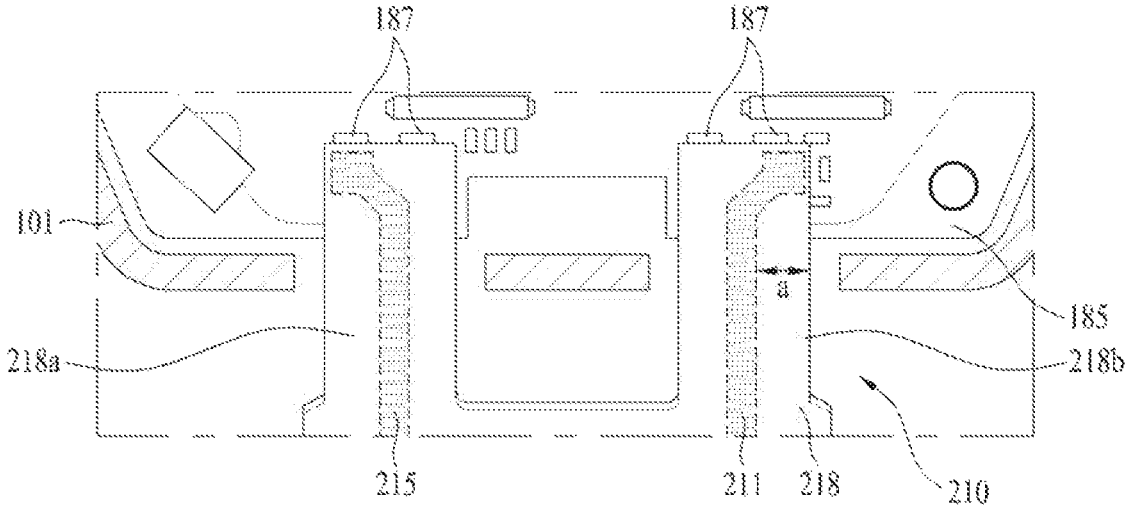

FIG. 9 is a diagram illustrating a part at which antenna modules 210/220 of the watch-type mobile terminal 100 and a mainboard 185 are contacted according to the present invention. A component mounted on the band 102 and a plurality of terminals for accessing are deployed to an end of the mainboard 185. In case of the first antenna module 210, since an end of the first radiator 211 and an end of the third radiator 215 are connected with the mainboard 185, two access terminals 187 are required. In case of the second antenna module 220, since ends of a pair of second radiators 221, an end of the fourth radiator, and an end of the fifth radiator 223 are connected with the mainboard 185, four access terminals 187 are required.

Since only two ends of the first antenna module 210 are connected with the mainboard 185, as shown in FIG. 9 (*a*), an end of one side can be divided into two. Since the watch-type mobile terminal 100 corresponds to a wearable device, waterproof performance is important. It may be able to prevent water from infiltrating the watch-type mobile terminal by forming an opening formed on the main body 101 as small as possible.

As shown in FIG. 9 (*b*), the insulating layer 218 of the first antenna module 210 is divided into two connecting units 218*a* and 218*b* and the first radiator and the third radiator are inserted into connection holes 107 of a small size, respectively. In this case, it may be able to secure performance only when the first radiator 211 and the third radiator 215 are deployed in a manner of being apart from the case of the main body 101 made of a metal material as much as a prescribed distance.

Since the four access lines are not connected with the mainboard 185, unlike the first antenna module 210 dividing one side, the second antenna module 220 can make the four access lines pass through a single hole of the main body 101. It may be able to further include a sealing unit 230 (refer to FIG. 3) configured to prevent foreign substance by blocking a space between the connection hole 107 and the first antenna module 210 and a space between the connection hole 107 and the second antenna module 220.

An access terminal 187 of the mainboard 185 connected with the antenna modules 210/220 mainly uses an access terminal 187 in a form of an elastic clip which is formed by folding a metal having elasticity. In order to distribute force, it is preferable to deploy a plurality of elastic clips in parallel. The first antenna module 210 may include two terminals only. Yet, in order to prevent an access error, two access terminals 187 are deployed in parallel to have strong elasticity and it may use one of the two access terminals only. In this case, as shown in FIG. 9 (*b*), in order to maintain a distance between the connection hole 107 and the first radiator 211 and a distance between the connection hole 107 and the second radiator 221, the first radiator and the second radiator are bent at a point adjacent to the access terminal 187 and are connected with the access terminal 187.

Figure 10:
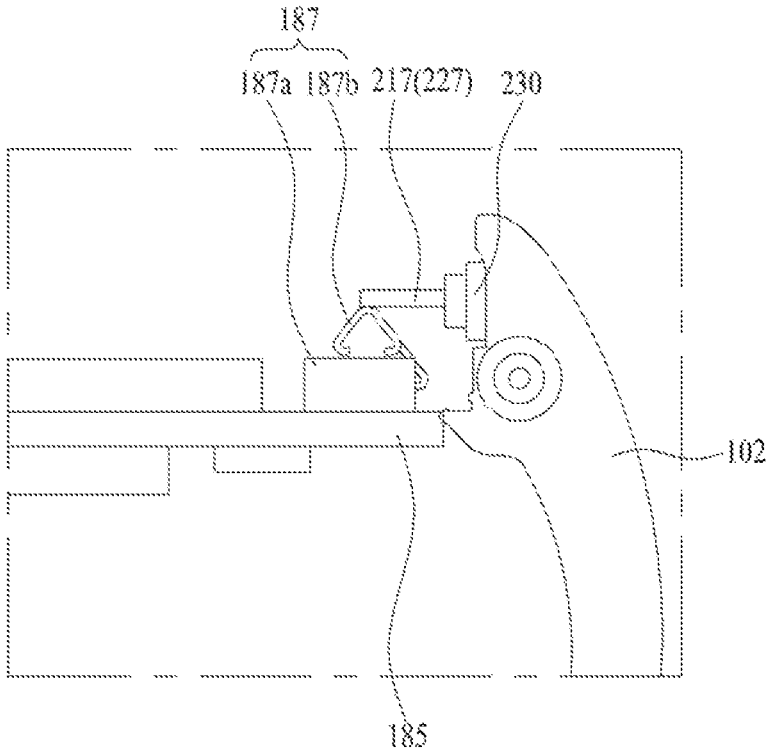
FIG. 10 is a diagram illustrating an access aspect between an antenna module and a main board of a watch-type mobile terminal according to the present invention.

FIG. 10 is a diagram illustrating an access aspect between antenna modules 210/220 and a main board 185 of a watch-type mobile terminal 100 according to the present invention. According to the present invention, an access terminal 187 contacted with the antenna modules 210/220 of the band 102 is positioned at the upper side of the mainboard 185. According to the related art, although a form of performing accessing in a rear side of the mainboard 185 is mainly used, it may be able to deploy the access terminal 187 to the upper side of the mainboard 185 to make a position where the access terminal 187 is connected with the connectors 217/227 to be separated from a hand of a user. Referring to FIG. 5, an object of the present invention is to make a distance (d1) between a point where the connectors 217/227 is contacted with the access terminal 187 and a wrist 10 to be separated from each other as much as possible.

As shown in FIG. 10, in general, an end part of the band 102 connected with the main body 101 is thicker and the end part of the band 102 has thickness similar to thickness of the main body 101. If the connector 217/227 connected with a radiator is deployed in a manner of being close to the front direction at the end part of the band 102, a distance from the wrist 10 can be more separated.

In case of applying a structure that the mainboard 185 is deployed to a rear side and a battery is deployed to the front side of the mainboard 185 for heat removal performance, a height different occurs between the access terminal 187 of the mainboard 185 and the connector 217.227 protruded from an end part of the band 102. If a length of an elastic clip 187*b* of the access terminal 187 is extended to match the height difference, since it is easy to deform the elastic clip, an access error may occur.

In order to match the height, as shown in FIG. 10, the access terminal 187 may further include a supporting unit 187*a*. If the access terminal 187 is implemented by putting the elastic clip 187*b* on the supporting unit 187*a*, it may be able to separate the point where the access terminal 187 is contacted with the connector 217/227 from a wrist of a user without changing a position of the mainboard 185.

As mentioned in the foregoing description, according to at least one embodiment of the present invention, it is able to enhance antenna efficiency by minimizing an impact among a plurality of antennas.

And, it is able to minimize deterioration of antenna efficiency by making a point where a mainboard is contacted with a radiator to be separated from a wrist 10 of a user.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A watch-type mobile terminal, comprising:

a main body;

a first band and a second band respectively connected with one side and another side of the main body;

a mainboard positioned inside the main body;

a first antenna module mounted on the first band and comprising a first radiator configured to transmit and receive a first radio signal in a manner of being connected with the mainboard;

a second antenna module mounted on the second band and comprising a second radiator configured to transmit and receive a second radio signal in a manner of being connected with the mainboard; and a controller configured to use the second antenna module as a ground of the first antenna module by maintaining a connected state between the second antenna module and the mainboard when wireless communication is performed through the first antenna module, wherein the second antenna module further comprises:

an insulating layer, the second radiator formed on a first face of the insulating layer;

a fourth radiator formed on a second face of the insulating layer such that the fourth radiator overlaps the second radiator; and a fifth radiator formed on the second face of the insulating layer such that the fifth radiator is spaced apart from the fourth radiator and does not overlap the second radiator.

2. The watch-type mobile terminal of claim 1, wherein the first radiator is extended in a manner of being bent several times and the second radiator is spirally wound several times.

3. The watch-type mobile terminal of claim 1, wherein the first radiator corresponds to a main antenna configured to transmit and receive an LTE (long term evolution) signal and wherein the second radiator corresponds to an NFC (near field communication) antenna or a wireless charging coil configured to charge a battery according to a change of a magnetic field.

4. The watch-type mobile terminal of claim 1, wherein the first radiator comprises:

a first pattern having one end connected with the mainboard, the first pattern extended in a first direction in a manner of being bent several times; and a second pattern bent several times at another end of the first pattern, the second pattern extended in a second direction corresponding to an opposite direction of the first direction.

5. The watch-type mobile terminal of claim 1, wherein the first antenna module further comprises a third radiator connected with the mainboard and separated from the first radiator.

6. The watch-type mobile terminal of claim 5, wherein the third radiator corresponds to a Bluetooth/WiFi antenna.

7. The watch-type mobile terminal of claim 5, wherein the first antenna module further comprises:

an insulating layer on which the first radiator and the third radiator are formed, the insulating layer containing a first connection part and a second connection part extended in one end of the insulating layer; and a connector contacting an access terminal of the mainboard in a manner of being coupled with end parts of the first connection part and the second connection part, wherein an end of the first radiator is positioned at a center part of the first connection part, and wherein an end of the third radiator is positioned at a center part of the second connection part.

8. The watch-type mobile terminal of claim 2, wherein the second radiator comprises:

a first access line positioned at one side of the first face of the insulating layer by passing through the second face of the insulating layer by penetrating the insulating layer from an inside of the spiral and penetrating the insulating layer again; and a second access line positioned at one side of the first face of the insulating layer in a manner of being extended from an outside of the spiral.

9. The watch-type mobile terminal of claim 1, wherein the fourth radiator corresponds to a MIMO (multiple input multiple output) antenna and wherein the fifth radiator corresponds to a GPS (global positioning system) antenna configured to receive a signal transmitted from a satellite.

10. The watch-type mobile terminal of claim 1, wherein the fourth radiator and the fifth radiator comprise a third access line and a fourth access line positioned at one side of the first face of the insulating layer by penetrating the insulating layer.

11. The watch-type mobile terminal of claim 1, wherein the mainboard comprises an access terminal positioned at an upper side of the mainboard, and wherein the first antenna module and the second antenna module comprise a connector connected with the access terminal.

12. The watch-type mobile terminal of claim 11, wherein thickness of a part in the first band and the second band adjacent to the main body is thicker than thickness of a different part in the first band and the second band, and wherein the connector is positioned at the upper side in a thickness direction of the first band and the second band.

13. The watch-type mobile terminal of claim 12, wherein the access terminal comprises a supporting unit protruded in a front side direction of the mainboard and an elastic clip protruded from the supporting unit.

14. The watch-type mobile terminal of claim 1, wherein the main body comprises a metal material and wherein the first antenna module and the second antenna module are electrically connected with the main body through the mainboard to make the main body operate as a ground.

15. The watch-type mobile terminal of claim 1, further comprising connection holes formed on one side and another side of the main body, wherein the first antenna module and the second antenna module further comprise a connector connected with the mainboard and a sealing unit configured to fill a space between the connection holes and the connector in a manner of being positioned near the connector.

* * * * *